US007519309B2

(12) United States Patent
Miyamoto et al.

(10) Patent No.: US 7,519,309 B2
(45) Date of Patent: Apr. 14, 2009

(54) IMAGE FORMING DEVICE

(75) Inventors: Hidetoshi Miyamoto, Osaka (JP); Eiji Gyoutoku, Hyogo (JP); Masanobu Maeshima, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 244 days.

(21) Appl. No.: 11/717,112

(22) Filed: Mar. 13, 2007

(65) Prior Publication Data

US 2007/0217813 A1 Sep. 20, 2007

(30) Foreign Application Priority Data

Mar. 16, 2006 (JP) ..... 2006-072278

(51) Int. Cl.
*G03G 15/16* (2006.01)

(52) U.S. Cl. ..... 399/101; 399/353; 399/354

(58) Field of Classification Search ..... 399/91, 399/98, 99, 101, 123, 302, 308, 343, 353, 399/354

See application file for complete search history.

(56) References Cited

U.S. PATENT DOCUMENTS 6,144,817 A * 11/2000 Takeuchi et al. ..... 399/51

FOREIGN PATENT DOCUMENTS

JP 2003-270972 A 9/2003

* cited by examiner

*Primary Examiner*—Hoan H Tran
(74) *Attorney, Agent, or Firm*—Global IP Counselors, LLP

(57) ABSTRACT

A photosensitive drum 18 is provided to carry electrostatic latent images. Developers 23K through 23Y supply toner to the electrostatic latent images formed on the photosensitive drum 18. Images formed on the photosensitive drum 18 are transferred to an intermediate transfer belt 12. A primary transfer roller 16 transfers toner images formed on the photosensitive drum 18 onto the intermediate transfer belt 12. The secondary transfer roller 7 transfers toner images on the intermediate transfer belt 12 onto sheets. The belt cleaning unit 17 has a fur brush 32 that electrically recovers toner, and recovers residual transfer toner remaining on the intermediate transfer belt 12 after a secondary transfer by the secondary transfer roller 7. The drive roller 13 is disposed in a position in opposition to the fur brush 32 sandwiching the intermediate transfer belt 12, and charges both the fur brush 32 and the secondary transfer roller 7.

20 Claims, 5 Drawing Sheets

| | Surface resistivity of interme diate transfer belt [Ω/□] | Volume resistance of brush fiber [Ω] | Transfer efficiency (%) | Transfer performance | Cleaning bias possible setting range [V] | Cleaning performance | Overall performance |
|---|---|---|---|---|---|---|---|
| Present invention 1-1 | $5.1\times10^{8}$ | | | | | | |
| 1-2 | | $3.2\times10^{5}$ | 92 | O | 250 | O | O |
| 1-3 | | $5.2\times10^{6}$ | 94 | O | 800 | O | O |
| 1-4 | | $1.2\times10^{7}$ | 93 | O | 1100 | O | O |
| | | $2.1\times10^{7}$ | 94 | O | 1000 | O | O |
| Present invention 2-1 | $3.2\times10^{9}$ | | | | | | |
| 2-2 | | $3.2\times10^{5}$ | 92 | O | 1000 | O | O |
| 2-3 | | $5.2\times10^{6}$ | 94 | O | 1100 | O | O |
| 2-4 | | $1.2\times10^{7}$ | 93 | O | 1300 | O | O |
| | | $2.1\times10^{7}$ | 94 | O | 400 | O | O |
| Present invention 3-1 | $1.0\times10^{10}$ | | | | | | |
| 3-2 | | $3.2\times10^{5}$ | 92 | O | 200 | O | O |
| 3-3 | | $5.2\times10^{6}$ | 94 | O | 800 | O | O |
| 3-4 | | $1.2\times10^{7}$ | 93 | O | 700 | O | O |
| | | $2.1\times10^{7}$ | 94 | O | 600 | O | O |
| Comparison example 1-1 | $5.1\times10^{8}$ | | | | | | |
| 1-2 | | $8.0\times10^{4}$ | 91 | O | 50 | X | X |
| | | $8.3\times10^{7}$ | 94 | O | 300 | X | X |
| Comparison example 2-1 | $3.2\times10^{9}$ | | | | | | |
| 2-2 | | $8.0\times10^{4}$ | 91 | O | 50 | X | X |
| | | $8.3\times10^{7}$ | 94 | O | 0 | X | X |
| Comparison example 3-1 | $1.0\times10^{10}$ | | | | | | |
| 3-2 | | $8.0\times10^{4}$ | 91 | O | 0 | X | X |
| | | $8.3\times10^{7}$ | 94 | O | 30 | X | X |
| Comparison example 4 | $3.0\times10^{8}$ | $5.2\times10^{6}$ | 85 | X | 500 | O | X |
| Comparison example 5 | $3.1\times10^{10}$ | $5.2\times10^{6}$ | 80 | X | 600 | X | X |

Table 1

Fig. 5

IMAGE FORMING DEVICE

CROSS-REFERENCE TO RELATED APPLICATIONS

This application claims priority to Japanese Patent Application No. 2006-072278 filed on Mar. 16, 2006. The entire disclosure of Japanese Patent Application No. 2006-072278 is hereby incorporated herein by reference.

BACKGROUND OF THE INVENTION

1. Field of the Invention

The present invention generally relates to color image forming devices such as photocopiers and printers that use xerography. More specifically, the present invention relates to image forming devices that transfer toner images formed on an image carrier onto a recording medium via an intermediate transfer member.

2. Background Information

In photocopiers and printers and the like that use xerography, an image forming method in which toner images formed on a photosensitive drum as an image carrier are transferred not to the recording medium but temporarily to an intermediate transfer member, and then the toner images on the intermediate transfer member are transferred to the recording medium is known. By using this method, it is possible to reduce transfer defects and color registration errors due to many causes such as the holding or surface condition of the recording medium.

However, when transferring the toner images formed on the intermediate transfer member onto the recording medium, a part of the toner is not transferred to the recording medium, but remains on the intermediate transfer member. This residual transfer toner remaining on the intermediate transfer member can have a deleterious effect on the next image forming operation. Therefore, image forming devices that use an intermediate transfer member are provided with a cleaning device to clean the residual transfer toner remaining on the intermediate transfer member after transfer from the intermediate transfer member to the recording medium.

The intermediate transfer member cleaning device has a simple configuration and can be installed at low cost, so blade cleaning systems in which a blade made from urethane rubber or the like is pressed against the intermediate transfer member to scrape the residual transfer toner off the intermediate transfer member are used. However, in the blade cleaning method the blade is pressed against the intermediate transfer member with a reasonable force, which causes the load torque to increase and can cause image defects such as jitter and so on. Also, if the blade is provided near the secondary transfer area, this can cause contamination of the sheet transport path with particles of toner and so on, which can cause image defects.

Therefore, image forming devices that use a fur brush cleaning method have been proposed to prevent load torque on the intermediate transfer member and image defects due to suspension of particles of toner (for example, see Japanese Patent Application Laid-open No. 2003-270972). In image forming devices that use the fur brush method, a fur brush in which brush fibers are applied to the surface of a cylindrical base member is rotated while in contact with the intermediate transfer member, and by applying a cleaning bias to the fur brush the toner is recovered both mechanically and electrically.

However, in image forming devices that use the fur brush method, it is necessary to provide an opposing electrode in a position in opposition to the fur brush that sandwiches the intermediate transfer belt to recover the toner electrically. Therefore, the configuration of the image forming device becomes more complex, which can increase the cost, and so on. Also, if the fur brush is provided near the area where the transfer from the intermediate transfer belt to the sheets occurs, the cleaning bias applied to the fur brush can change the transfer bias so that stable image output can be difficult.

In view of the above, it will be apparent to those skilled in the art from this disclosure that there exists a need for an improved image forming device. This invention addresses this need in the art as well as other needs, which will become apparent to those skilled in the art from this disclosure.

SUMMARY OF THE INVENTION

It is an object of the present invention to be able to recover residual transfer toner from an intermediate transfer member without making the configuration of the device complex or making the device costly, and so on. Also, it is an object of the present invention to be able to output good images stably, even if a fur brush is provided near the area where transfer from the intermediate transfer belt to the sheets occurs.

An image forming device according to according to a first aspect of the present invention has an image carrier, a developer, an intermediate transfer belt, a primary transfer member, a secondary transfer member, a belt cleaning unit, and an opposing electrode. The image carrier is a member that carries electrostatic latent images. The developer is a member that provides toner to electrostatic latent images formed on the image carrier. The intermediate transfer belt is a member to which toner images formed on the image carrier are transferred. The primary transfer member is a member that transfers toner images formed on the image carrier to the intermediate transfer belt. The secondary transfer member is a member that transfers toner images on the intermediate transfer belt to sheets. The belt cleaning unit is a unit that has a fur brush that electrically recovers toner, and that recovers residual transfer toner remaining on the intermediate transfer belt after a secondary transfer by the secondary transfer member. The opposing electrode is disposed in a position in opposition to the fur brush and the secondary transfer member to sandwich the intermediate transfer belt.

An image forming device according to a second aspect of the present invention is the image forming device according to the first aspect, wherein the belt cleaning unit is configured so that it can be separated from the intermediate transfer belt.

An image forming device according to a third aspect of the present invention is the image forming device according to the first aspect, wherein the fur brush has brush fibers formed from an electrically conducting material, the intermediate transfer belt is formed from an electrically conducting material whose surface resistivity is within the range $5.1\times10^{8}$ through $1.0\times10^{10}$ Ω/□, and the volume resistance of the brush fibers is within the range $3.2\times10^{5}$ through $2.1\times10^{7}$Ω.

An image forming device according to fourth aspect of the present invention is the image forming device according to the second aspect, wherein the fur brush has brush fibers formed from an electrically conducting material, the intermediate transfer belt is formed from an electrically conducting material whose surface resistivity is within the range $5.1\times10^{8}$ through $1.0\times10^{10}$ Ω/□, and the volume resistance of the brush fibers is within the range $3.2\times10^{5}$ through $2.1\times10^{7}$Ω.

An image forming device according to a fifth aspect of the present invention is the image forming device according to first aspect, wherein the opposing electrode is a grounded roller member disposed in opposition to the fur brush whose surface is formed from an electrically conducting elastic member.

An image forming device according to a sixth aspect of the present invention is the image forming device according to the second aspect, wherein the opposing electrode is a grounded roller member disposed in opposition to the fur brush whose surface is formed from an electrically conducting elastic member.

An image forming device according to a seventh aspect of the present invention is the image forming device according to the third aspect, wherein the opposing electrode is a grounded roller member disposed in opposition to the fur brush whose surface is formed from an electrically conducting elastic member.

An image forming device according to an eight aspect of the present invention is an image forming device according to the fourth aspect, wherein the opposing electrode is a grounded roller member disposed in opposition to the fur brush whose surface is formed from an electrically conducting elastic member.

An image forming device according to a ninth aspect of the present invention is an image forming device according to the first aspect, wherein the cleaning unit further includes a housing having bearing, at least a portion of the housing being formed from an electrically conducting material to which a bias is applied, and a recovery roller formed from an electrically conducting material and that is supported by the housing.

An image forming device according to a tenth aspect of the present invention is the image forming device according to the second aspect, wherein the cleaning unit further includes a housing having a bearing, at least a portion of the housing being formed from an electrically conducting material to which a bias is applied, and a recovery roller formed from an electrically conducting material and supported by the housing.

An image forming device according to an eleventh aspect of the present invention is an image forming device according to the third aspect, wherein the cleaning unit further includes a housing having a bearing, at least a portion of the housing being formed from an electrically conducting material to which a bias is applied, and a recovery roller formed from an electrically conducting material and supported by the housing.

An image forming device according to a twelfth aspect of the present invention is the image forming device according to the fourth aspect, wherein the cleaning unit further includes a housing having bearing, at least a portion of the housing being formed from an electrically conducting material to which a bias is applied, and a recovery roller formed from an electrically conducting material and supported by the housing.

An image forming device according to a thirteenth aspect of the present invention is the image forming device according to fifth aspect, wherein the cleaning unit further includes a housing having a bearing, at least a portion of the housing being formed from an electrically conducting material to which a bias is applied, and a recovery roller formed from an electrically conducting material and supported by the housing.

An image forming device according to a fourteenth aspect of the present invention is the image forming device according to the eighth aspect, wherein the cleaning unit further includes a housing having a bearing, at least a portion of the housing being formed from an electrically conducting material to which a bias is applied, and a recovery roller formed from an electrically conducting material and supported by the housing.

An image forming device according to a fifteenth aspect of the present invention is an image forming device according to the ninth aspect, wherein the distance from the center of the rotation axis of the fur brush to the intermediate transfer belt is greater than the distance from the center of the rotation axis of the fur brush to the surface of the recovery roller.

An image forming device according to a sixteenth aspect of the present invention is the image forming device according to the tenth aspect, wherein the distance from the center of the rotation axis of the fur brush to the intermediate transfer belt is greater than the distance from the center of the rotation axis of the fur brush to the surface of the recovery roller.

An image forming device according to a seventeenth aspect of the present invention is the image forming device according to the eleventh aspect, wherein the distance from the center of the rotation axis of the fur brush to the intermediate transfer belt is greater than the distance from the center of the rotation axis of the fur brush to the surface of the recovery roller.

An image forming device according to an eighteenth aspect of the present invention is the image forming device according to the twelfth aspect, wherein the distance from the center of the rotation axis of the fur brush to the intermediate transfer belt is greater than the distance from the center of the rotation axis of the fur brush to the surface of the recovery roller.

An image forming device according to a nineteenth aspect of the present inventions is the image forming device according to the thirteenth aspect, wherein the distance from the center of the rotation axis of the fur brush to the intermediate transfer belt is greater than the distance from the center of the rotation axis of the fur brush to the surface of the recovery roller.

An image forming device according to a twentieth aspect of the present invention is the image forming device according to the fourteenth aspect, wherein the distance from the center of the rotation axis of the fur brush to the intermediate transfer belt is greater than the distance from the center of the rotation axis of the fur brush to the surface of the recovery roller.

In the present invention, in an image forming device using the fur brush method, the opposing electrode of the fur brush provided in the belt cleaning unit is the same as the opposing electrode of the secondary transfer member. Therefore, there is no need to provide a separate opposing electrode for the fur brush, and it is possible to simplify the structure of the image forming device and reduce the cost.

Also, only one photosensitive drum is provided in the image forming device. For each revolution of the intermediate transfer belt cyan, magenta, yellow, and black toner images formed on the photosensitive drum are transferred (primary transfer) and superimposed successively onto the intermediate transfer member. A full color toner image is formed on the intermediate transfer member after a predetermined number of revolutions of the intermediate transfer member. However, it is possible to separate the belt cleaning unit from the intermediate transfer belt so that during the primary transfer operations the toner on the intermediate transfer belt is not recovered.

Furthermore, even if the belt cleaning unit is provided near the secondary transfer area, it is possible to ensure good transfer performance in the secondary transfer area and good cleaning performance by the belt cleaning unit.

These and other objects, features, aspects, and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure:

FIG. 5 is a view of Table 1 showing intermediate transfer belt surface resistivity, brush fiber volume resistance, transfer efficiency, transfer performance evaluation, cleaning bias possible setting range, cleaning performance evaluation, and overall evaluation, for the present invention and comparison examples.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
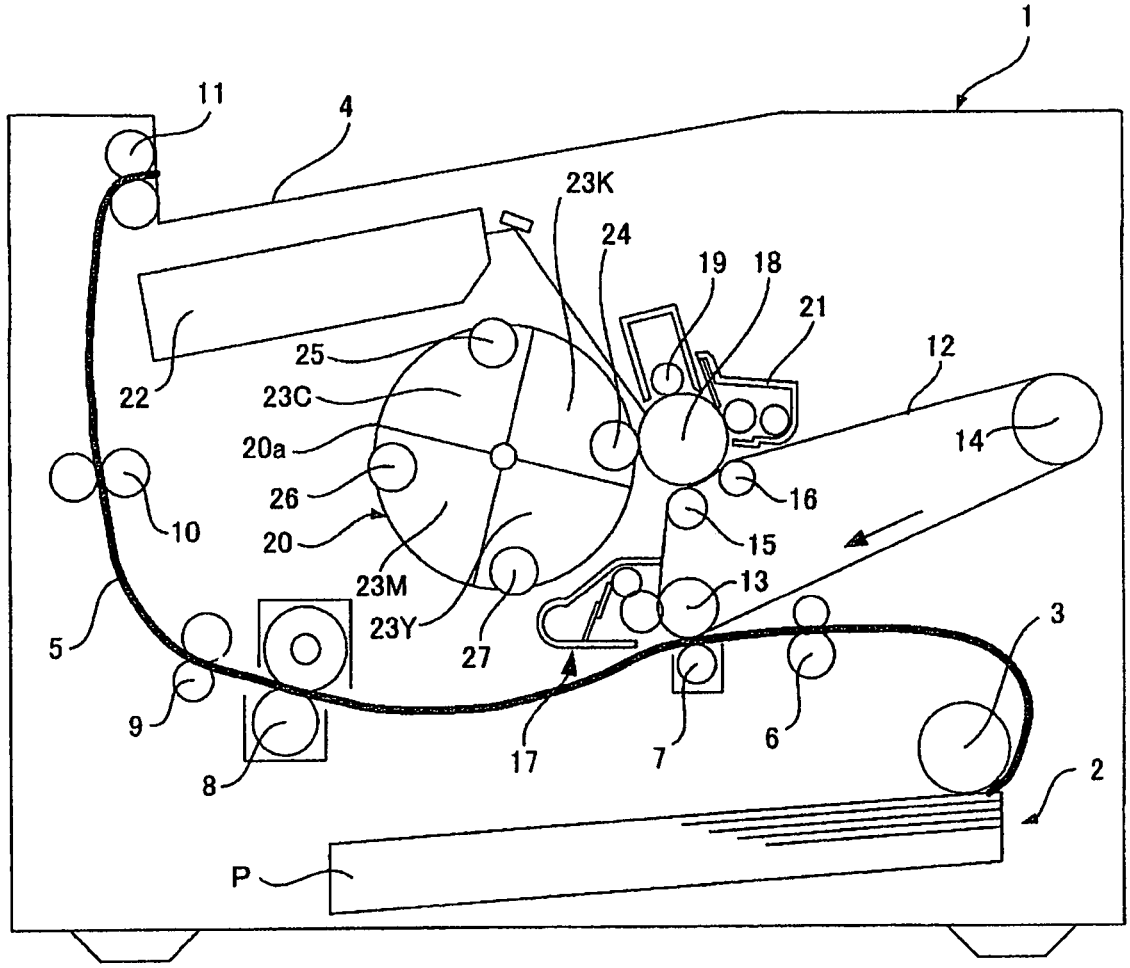
FIG. 1 is a cross-sectional diagrammatical view showing a schematic configuration of an image forming device according to the present invention.

The following is an explanation of an embodiment of the present invention with reference to the drawings. FIG. 1 is a cross-sectional diagrammatical view showing the schematic configuration of an image forming device 1 according to the present invention. As an example, a color laser printer is shown.

A sheet supply unit 2 that includes a sheet supply cassette or the like that stores a stack of sheets is provided in the bottom of the image forming device 1. A separation supply and delivery roller 3 is provided at one end of the sheet supply unit 2, and supplies the topmost sheet of loaded sheets P one sheet at a time.

Above the sheet supply unit 2 a transport path 5 is formed that extends approximately horizontally from the right of the main body to the left of the main body in FIG. 1, and then from the left side of the main body extends upwards to a sheet discharge tray 4 formed at the top of the main body. The separation supply and delivery roller 3, a pair of registration rollers 6, a secondary transfer roller (secondary transfer member) 7, a pair of fixing rollers 8, pairs of transport rollers 9 and 10, and a pair of discharge rollers 11 are disposed along the transport path 5 from the upstream side in that order.

An intermediate transfer belt 12 is disposed so that it can freely rotate above the transport path 5 that extends in the horizontal direction. The intermediate transfer roller 12 is wound around a drive roller 13, a driven roller 14, a tension roller 15, and a primary transfer roller (primary transfer member) 16. When the drive roller 13 is driven to rotate, the other rollers also rotate, and the intermediate transfer belt 12 rotates in the direction of the arrow shown in FIG. 1, in other words in the clockwise direction. It is preferable that an electrically conductive sheet with, for example, a polymer alloy of polycarbonate and polyvinylidine difluoride as a base resin is used as the intermediate transfer belt 12. It is preferable that both ends should be overlapped and joined to form a ring-shaped belt, or that the belt is seamless with no joint.

The secondary transfer roller 7 and the drive roller 13 are disposed in opposition to each other with the intermediate transfer belt 12 sandwiched in between. Also, the secondary transfer roller 7 is pressed against the drive roller 13 via the intermediate transfer belt 12 by a pressing device that is not shown in the drawings. The area where the secondary transfer roller 7 and the intermediate transfer belt 12 contact is the secondary transfer area. Also, a belt cleaning unit 17 is disposed downstream of the secondary transfer area in the direction of rotation of the intermediate transfer belt 12 to recover residual transfer toner on the intermediate transfer belt 12 after a secondary transfer.

The drive roller 13 is formed with an electrically conductive elastic layer as a surface layer that is grounded with an electrically conducting member that is not shown in the drawings. Therefore the drive roller 13 also serves as an opposing electrode to the secondary transfer roller 7. By applying a predetermined transfer bias to the secondary transfer roller 7, secondary transfer of toner images on the intermediate transfer belt 12 onto the sheets P occurs.

Also, a photosensitive drum 18, which is an image carrier, is disposed above the intermediate transfer belt 12. The photosensitive drum 18 is disposed to contact the intermediate transfer belt 12 downstream of the tension roller 15 and upstream of the primary transfer roller 16 in the direction of rotation of the intermediate transfer belt 12. Also, the intermediate transfer belt 12 is pressed against the photosensitive drum 18 by the tension roller 15 and so on. The part where the intermediate transfer belt 12 contacts the photosensitive drum 18 is the primary transfer area.

In this way, the primary transfer roller 16 is configured not to press against the photosensitive drum 18 via the intermediate transfer belt 12. Therefore, it is possible to apply a difference in linear velocity between the intermediate transfer belt 12 and the photosensitive drum 18 at the primary transfer area. Therefore, it is possible to prevent the occurrence of loss of minute dots and the like during primary transfer. Also, even if the primary transfer area is formed immediately downstream of the drive roller 13, slackness and slip of the intermediate transfer belt 12 can be prevented, and the linear velocity of the intermediate transfer belt 12 in the primary transfer area can be stabilized.

Here, in the configuration as described above, a primary transfer current flows from the primary transfer roller 16 to the photosensitive drum 18 through the intermediate transfer belt 12. Therefore it is preferable that the surface resistivity of the intermediate transfer belt 12 be set within the range $5.1\times10^{8}$ through $1.0\times10^{10}$ Ω/□. If the surface resistivity is too low, too much current will flow in the surface of the intermediate transfer belt 12, and current will flow to the tension roller 15, so electrical discharge can easily occur on the upstream side of the primary transfer area before transfer. On the other hand, if the surface resistivity is too high, it will be difficult for current to flow in the surface of the intermediate transfer belt 12, and sufficient transfer current will not be obtained. The normal intermediate transfer belt 12 is formed extremely thin, in the range 100 through 150 μm, so there is no particular need to consider the volume resistance value of the intermediate transfer belt 12.

The photosensitive drum 18 is driven to rotate in the counterclockwise direction by a drive device not shown in the drawings. Also, a contact type charging device 19, a developing unit 20, the primary transfer roller 16, and a drum cleaning unit 21 are disposed along the photosensitive drum 18 in that order from the top along the direction of rotation of the photosensitive drum 18. The charging roller 19 contacts the top of the photosensitive drum 18 and rotates together with the photosensitive drum 18. A laser optical unit 22 that uses a commonly known optical system is disposed above the developing unit 20.

The developing unit 20 is substantially cylindrical shaped, and rotatably supported at both ends. The inside of the developing unit 20 is divided into four compartments by cross-shaped partition walls 20*a*. Four developers 23K, 23C, 23M, and 23Y are disposed in these compartments, corresponding to toner in each of the colors black (K), cyan (C), magenta (M), and yellow (Y). The layout of the developers shown in the figure is an example, and the present embodiment is not limited to this layout.

Each developer 23K through 23Y respectively includes a developing roller 24, 25, 26, and 27 that is individually driven to rotate. Also, the developing unit 20 is connected to a drive unit that is not shown in the drawings. The developing unit 20 is rotated by the drive unit, and one of the developing rollers 24 through 27 of the developers 23K through 23Y is selectively brought into opposition with the photosensitive drum 18. In this way, developing operations are carried out.

Next, the image forming operation by the image forming device 1 configured as described above is explained. First, the charging roller 19 is rotated by the rotation of the photosensitive drum 18. The surface of the photosensitive drum 18 is uniformly charged by the rotation of the charging roller 19. Then the laser optical unit 22 is operated based on input image signals, and laser light irradiates the photosensitive drum 18 after charging. After irradiation with laser light, an electrostatic latent image is formed on the surface of the photosensitive drum 18. The electrostatic latent image formed in this way is developed by the developing unit 20 as described above, and transferred to the clockwise rotating intermediate transfer belt 12 by the primary transfer roller 16.

In other words, when forming a monochrome image, only the developing roller 24 of the black developer 23K is brought to a position in opposition to the photosensitive drum 18 on which an electrostatic latent image is formed, and a black toner image is formed on the photosensitive drum 18. Then the black toner image formed on the photosensitive drum 18 is transferred onto the rotating intermediate transfer belt 12 by the primary transfer roller 16 to form a monochrome image.

Also, when forming a color image, the developing unit 20 is rotated by the drive unit, each of the developing rollers 24 through 27 of the four developers 23K through 23Y is selectively brought in turn to a position in opposition to the photosensitive drum 18. Then by supplying toner in each color to the photosensitive drum 18, toner images in each color are formed on the photosensitive drum 18. Then the toner images in each color formed on the photosensitive drum 18 are transferred in turn to the rotating intermediate transfer belt 12 by the primary transfer roller 16, and by superimposing them the color image is formed. When forming a color image the belt cleaning unit 17 is disposed at a distance from the intermediate transfer belt 12 during the primary transfer operations.

Then secondary transfer of the monochrome or color image on the intermediate transfer belt 12 is carried out in one operation onto a sheet P supplied from the sheet supply unit 2 by the separation supply and delivery roller 3 and transported on the transport path 5 by the pair of registration rollers 6. The sheet P onto which a monochrome or color image has been transferred in this way is transported approximately horizontally on the transport path 5, and the toner image is fixed by heating by the pair of fixing rollers 8. After fixing, the transport direction changes upwards downstream of the pair of transport rollers 9, the sheet P is transported further on the transport path by the pair of transport rollers 10, and is finally discharged into the discharge tray 4 by the pair of discharge rollers 11.

Residual transfer toner that remains on the photosensitive drum 18 after primary transfer is removed by the drum cleaning unit 21. Also, residual transfer toner that remains on the intermediate transfer belt 12 after a secondary transfer is removed by the belt cleaning unit 17. Also, removed toner is transported to a waste bottle that is not shown in the drawings by a toner recovery device such as a recovery screw or the like.

Figure 2:
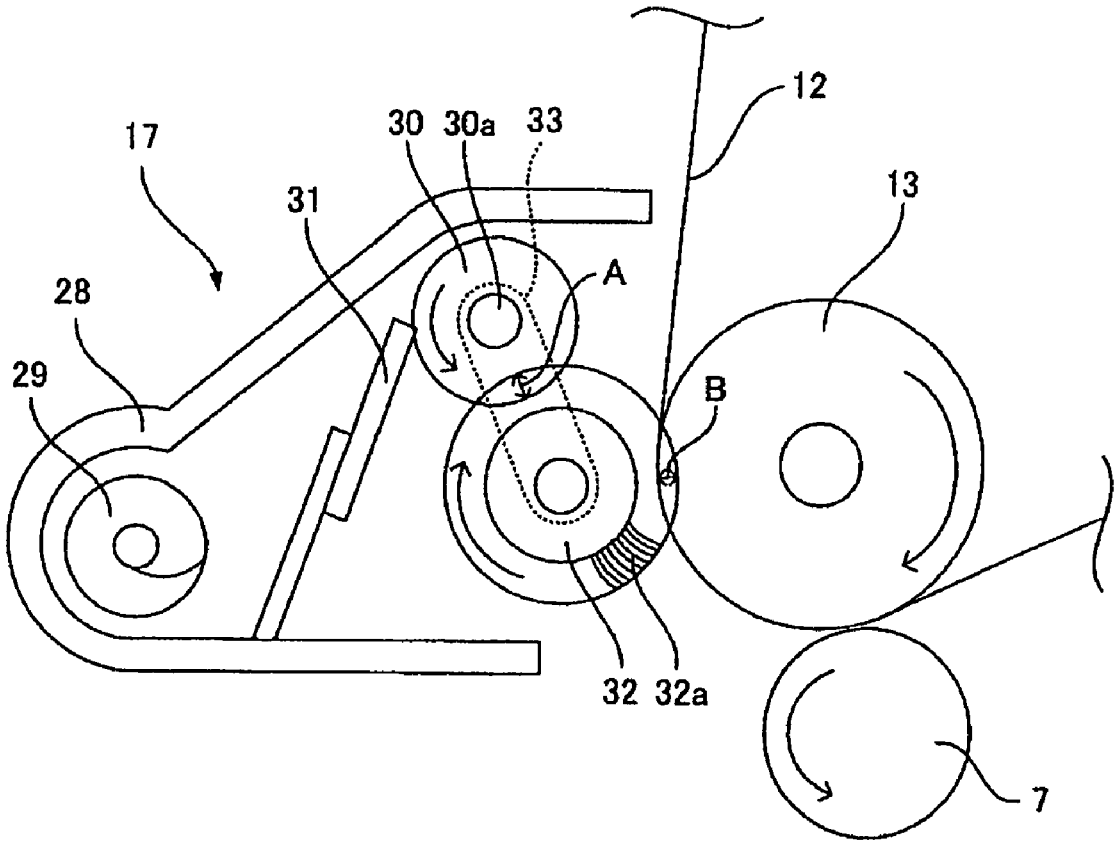
FIG. 2 is a cross-sectional view showing the schematic configuration of a belt cleaning unit of the image forming device.

Here the belt cleaning unit 17 that recovers residual transfer toner remaining on the intermediate transfer belt 12 after a secondary transfer is explained in detail with reference to FIG. 2. FIG. 2 is a cross-sectional view showing the schematic configuration of the belt cleaning unit 17. The belt cleaning unit 17 includes a housing 28, a recovery screw 29, a recovery roller 30, a rubber blade 31, and a fur brush 32.

The housing 28 forms the main frame of the belt cleaning unit 17, and covers the recovery roller 30, the rubber blade 31, and the fur brush 32. Also, the housing 28 prevents the recovered residual transfer toner from being dispersed outside the belt cleaning unit 17. Furthermore, the recovery screw 29 is disposed at the bottom of the housing 28 and discharges the recovered residual transfer toner within the housing 28 to a waste bottle that is not shown in the drawings that is disposed within the main body of the image forming device 1.

The recovery roller 30 is preferably formed from an electrically conducting material, having a rotation shaft 30*a* that is rotatably supported at both ends by the housing 28. At least one of the bearings that support the two ends of the rotation shaft 30*a* provided in the housing 28 is an electrically conducting bearing that conducts from the housing 28, and a cleaning bias is applied to the recovery roller 30 through the electrically conducting bearing via the housing. Also, the rubber blade 31 that scrapes off toner adhering to the surface of the recovery roller 30 presses against the recovery roller in a direction that is in opposition to the rotation direction of the recovery roller 30.

The fur brush 32 is a long woven fabric on which electrically conducting brush fibers 32*a* have been densely implanted, that is spirally wound around and fixed to the full periphery of a roller base member. The fur brush 32 is rotatably supported by a support member 33 made from electrically non-conducting material to contact the recovery roller 30 with an overlap amount A. Here, the overlap amount A is defined as the maximum amount by which the tips of the brush fibers 32*a* would impinge into the position of the recovery roller 30 if the recovery roller 30 were not there.

Nylon resins such as nylon 6 or nylon 12, polyester resins, or acrylic resins in which carbon black is uniformly dispersed to give electrical conductivity are suitable for use as the material of the brush fibers 32*a*. Also, if some of the brush fibers 32*a* fall out, when the fur brush 32 rubs against the intermediate transfer belt 12 with a non-uniform surface density, small vibrations can occur. However, to prevent this type of problem the brush fibers 32*a* may be coated in advance with fluorine resin powder as a lubricating agent.

Also, the support member 33 that supports the fur brush 32 is configured so that it can swivel about the rotation shaft 30*a* of the recovery roller 30 as center. Also, a forcing member that is not shown on the drawings acts on the support member 33, so that the fur brush 32 is pressed against the drive roller 13 via the intermediate transfer belt 12. An eccentric cam (which is not shown in the drawings) is disposed concentrically with the rotation axis of the drive roller 13. By making the support member 33 and the eccentric cam contact each other, the fur brush 32 contacts the intermediate transfer belt 12 with an amount of overlap B.

Here, the distance between the center of rotation 32*a* of the fur brush 32 and the intermediate transfer belt 12 is greater than the distance between the center of rotation 32*a* and the surface of the recovery roller 30. In other words, the amount of overlap B of the fur brush 32 with the intermediate transfer roller 12 is designed to be not larger than the amount of overlap A of the fur brush 32 with the recovery roller 30. This is because if the amount of overlap B is designed to be larger, there is a part of the brush fibers 32*a* that rubs against the intermediate transfer belt 12 that cannot contact the recovery roller 30. Therefore toner adhering to that part cannot be recovered by the recovery roller 30, so there is a danger that the toner will re-adhere to the intermediate transfer belt 12.

Also, as stated above during the primary transfer operation, when the toner should not be recovered from the intermediate transfer belt 12, by rotating the eccentric cam (not shown in the drawings) and swiveling the support member 33, the fur brush 32 can be separated from the intermediate transfer belt 12. The support member 33 that supports the fur brush 32 swivels about the rotation shaft 30*a* of the recovery roller 30 as center. Therefore, the amount of overlap A of the fur brush 32 with respect to the recovery roller 30 is always maintained constant.

The following is an explanation of the operation of the belt cleaning unit 17 configured as described above. The fur brush 32 rotates in the clockwise direction shown in FIG. 2, and at the area of contact with the intermediate transfer belt 12 the direction of movement of the brush fibers 32*a* and the intermediate transfer belt 12 are mutually opposite. Also, the recovery roller 30 is rotated in the counterclockwise direction shown in FIG. 2, and at the area in contact with the fur brush 32 the recovery roller 30 and the brush fibers 32*a* move in the same direction.

It is desirable that the linear velocity ratio between the intermediate transfer belt 12 and the fur brush 32 and the linear velocity ratio between the recovery roller 30 and the fur brush 32 are both within the range 0.5 through 2.0. Also, residual transfer toner on the intermediate transfer belt 12 is mechanically brushed off by the brush fibers 32*a*. However, in order to obtain a sufficient brushing effect and not damage the surface of the intermediate transfer belt 12, when using the resin brush fiber material referred to above it is desirable that the thickness of the brush fibers be formed in the range 1.11 through 6.67 decitex.

When toner that is not transferred to the sheets P in the secondary transfer area reaches near the position where the fur brush 32 is disposed, the toner is mechanically brushed from the intermediate transfer belt 12 by the brush fibers 32*a*. At this time, a cleaning bias whose polarity is opposite to that of the toner charge polarity is applied to the recovery roller 30. Here, the drive roller 13 is electrically conducting, as stated above. Therefore a cleaning current flows from the recovery roller 30 to the drive roller 13 via the fur brush 32 and the intermediate transfer belt 12. The toner that is brushed by the brush fibers 32*a* does not drop down, but adheres electrically to the brush fibers 32*a*.

If the surface resistivity of the intermediate transfer belt 12 is in the range $5.1\times10^8$ through $1.0\times10^{10}$ Ω/□ as stated above, it is desirable that the volume resistance of the brush fibers 32*a* is set within the range $3.2\times10^5$ through $2.1\times10^7$Ω. This is because if the volume resistance of the brush fibers 32*a* is too high, it will be difficult for the current to flow and sufficient cleaning current cannot be ensured. On the other hand, if the volume resistance is too low, too much cleaning current flows to the drive roller 13, so the secondary transfer bias will be changed.

Also, the toner adhering to the brush fibers 32*a* is electrically transferred to the recovery roller 30 at the area of contact of the fur brush 32 and the recovery roller 30. The toner that is transferred to the recovery roller 30 is scraped off by the rubber blade 31 and falls to the bottom of the housing 28, where the toner is transferred to the waste bottle by the recovery screw 29.

As described above, in the image forming device 1 that uses the fur brush method, the drive roller 13, which is used as the opposing electrode for the secondary transfer roller 7, is also used as the opposing electrode for the belt cleaning unit 17. By doing so, there is no necessity to provide a separate opposing electrode at a position in opposition to the position where the fur brush 32 contacts the intermediate transfer belt 12. Therefore it is possible to simplify the construction and lower the cost of the image forming device 1.

EXAMPLE OF EXECUTION

In order to confirm the effect of the present invention as an example of execution, an image forming device 1 according to the present embodiment with an intermediate transfer belt 12 with a surface resistivity in the range $5.1\times10^8$ through $1.0\times10^{10}$ Ω/□ was used. The volume resistance of the brush fibers 32*a* used in the fur brush 32 was varied within the range $3.2\times10^5$ through $2.1\times10^7$Ω, and image forming was carried out. The transfer performance in the secondary transfer area and the cleaning performance of the belt cleaning unit 17 were evaluated (present invention 1 through 3). As comparison examples, the same parameters were evaluated for an image forming device for which the surface resistivity of the intermediate transfer belt 12 and the volume resistance of the brush fibers 32*a* was outside the above range (comparison examples 1 through 5).

In the present invention 1 through 3 and the comparison example 1 through 5, nylon 6 in which carbon black was uniformly dispersed was used as the material of the brush fibers 32*a*. The thickness of the brush fibers 32*a* was 2.22 decitex, and their length was 3.5 mm. The amount of overlap A of the fur brush 32 with the recovery roller 30 and the amount of overlap B of the fur brush 32 with the intermediate transfer roller 12 were both set to 1.0 mm. The linear velocity ratio of the fur brush 32 with respect to the intermediate transfer belt 12 was set to 1.1.

In FIG. 5, Table 1 shows the intermediate transfer belt 12 surface resistivity [Ω/□], the brush fiber 32*a* volume resistance [Ω], the transfer efficiency (%), the transfer performance evaluation, the cleaning bias possible setting range [V], the cleaning performance evaluation, and the overall evaluation, for the present invention 1 through 3 and comparison examples 1 through 5.

In the evaluation of transfer performance, images were formed with the secondary transfer bias set to a constant current output in the range 5 through 50 μA. When the transfer efficiency onto the sheets P was 90% or greater, the evaluation was indicated by "O (good)," and when the transfer efficiency was less than 90% the evaluation was indicated by "x (no good)." The transfer efficiency is a measure of how much of the toner adhering to the intermediate transfer belt 12 prior to a secondary transfer is transferred to the sheets P. If the mass of the toner on the intermediate transfer belt 12 is TB, and the mass of the toner on the sheets is TP, the transfer efficiency is calculated by: transfer efficiency=(TP/TB)×100.

In the evaluation of cleaning performance, the cleaning bias applied to the recovery roller 30 was varied at constant voltage output in the range 500 through 2,000 V, and images were formed. For each cleaning bias the amount of toner that was not cleaned but remained on the intermediate transfer belt 12 without being recovered by the belt cleaning unit 17 was measured. If the cleaning bias range for which the amount of residual toner that was not cleaned was equal to or less than a predetermined value was 100 V or more, the evaluation was "O (good)," and if the range was less than 100 V the evaluation was "x (no good)."

Toner that was not cleaned was removed from the intermediate transfer belt 12 using adhesive tape. The adhesive tape with the toner adhering to it was placed on a PET sheet (thickness 100 μm) and the transmission density (TD) was measured using a transmission density measuring device (310TR, manufactured by X-Rite). If the TD value was 0.05 or less, it was assumed that the amount of residual toner that was not cleaned was less than the predetermined amount.

Figure 3:
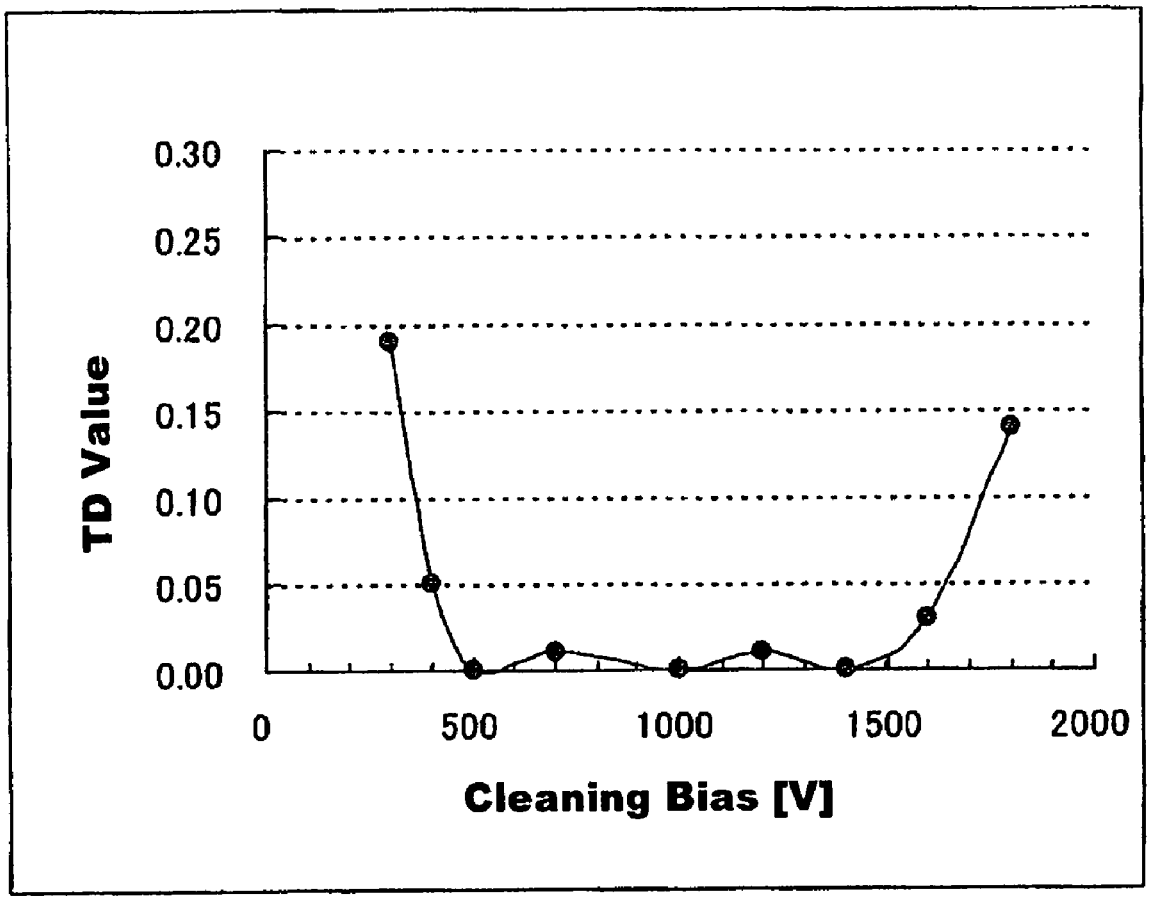
FIG. 3 is a view of a diagram showing the relationship between each cleaning bias and the TD (transmission density) values in the present invention.
Figure 4:
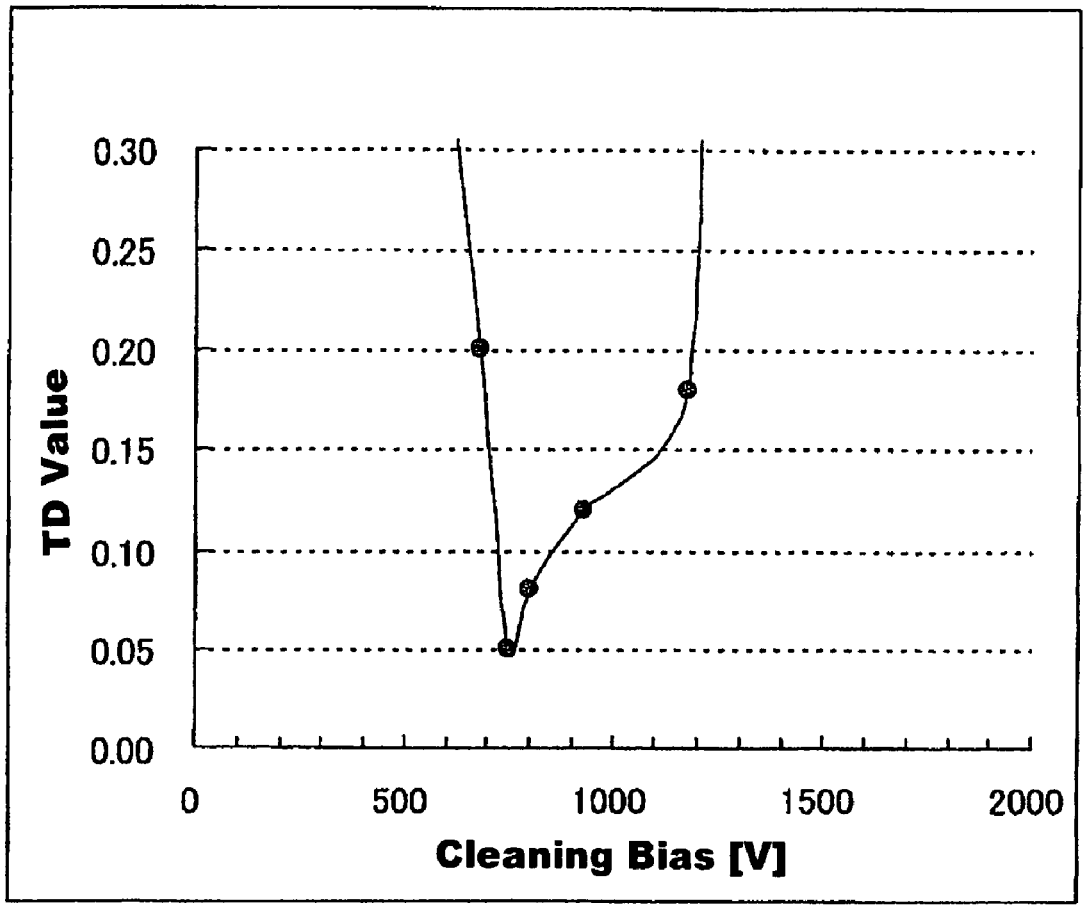
FIG. 4 is a view of a diagram showing the relationship between each cleaning bias and the TD values in a comparison example.

The following is an explanation of the evaluation of cleaning performance with reference to FIGS. 3 and 4. FIGS. 3 and 4 show the relationship between each cleaning bias and the TD value in the present invention 2-1 and the comparison example 2-1 respectively. As shown in FIG. 3, the cleaning bias possible setting range for which the TD value was 0.05 or less exceeds 100 V, so the evaluation result for the present invention 2-1 is "O (good)." However, as shown in FIG. 4, in the comparison example 2-1 the cleaning bias possible setting range for which the TD value was 0.05 or less is only 50 V. Because the possible setting range is less than 100 V, the evaluation result for the comparison example 2-1 is "x (no good)."

Also, an overall evaluation was carried out based on the evaluation results for transfer performance and cleaning performance. If both the transfer performance and cleaning performance were "O (good)," the overall evaluation was O (good)." However, if at least one of the transfer performance and cleaning performance was "x (no good)," the overall evaluation was "x (no good)."

As shown in Table 1 of FIG. 5, in comparison examples 4 and 5, the surface resistivity of the intermediate transfer belt 12 is not set within the range for the embodiment described above. Therefore as stated above, either too much current flows in the surface of the intermediate transfer belt 12, or the current flows with difficulty and it is not possible to obtain sufficient transfer current. Therefore the transfer efficiency is poor at less than 90%, so the transfer evaluation is "x," and therefore the overall evaluation is "x."

Also, in comparison examples 1 through 3, the surface resistivity of the intermediate transfer belt 12 was set within the range of the embodiment as described above. Therefore the transfer efficiency in each case was 90% or greater, and the transfer performance evaluation was "O." However, the volume resistance of the brush fibers 32*a* was not set within the range of the embodiment as described above. Therefore the cleaning bias possible setting range was less than 100 V, so the cleaning performance evaluation was "x," and therefore the overall evaluation was "x."

However, in the present invention 1 through 3, the surface resistivity of the intermediate transfer belt 12 was set within the range of the embodiment as described above, similar to comparison examples 1 through 3. Therefore the transfer efficiency in each case was equal to or greater than 90%, and the transfer performance evaluation was "O." Furthermore the volume resistance of the brush fibers 32*a* was set within the range of the embodiment as described above. Therefore, the cleaning bias possible setting range was 100 V or greater, and the cleaning performance evaluation was "O." Therefore, the overall evaluation was "O."

As described above, in an image forming device 1 using the fur brush method, in a configuration in which the drive roller 13, which is used as the opposing electrode for the secondary transfer roller 7, is also used as the opposing electrode for the belt cleaning unit 17, by setting the surface resistivity of the intermediate transfer belt 12 within the range $5.1\times10^{8}$ through $1.0\times10^{10}$ Ω/□, and setting the volume resistance of the brush fibers 32*a* within the range $3.2\times10^{5}$ through $2.1\times10^{7}$Ω, it is possible to provide an image forming device with good transfer performance in the secondary transfer area and good cleaning performance in the belt cleaning device 17.

The present embodiment is not limited to the embodiment described above, and various changes are possible without deviating from the intention of the present invention. For example, in the embodiment as described above, a rotary type developing unit was used, as shown in FIG. 1. However, the present invention may also be applied in the same way to an image forming device in which, instead of this kind of rotary type developing unit, a plurality of developing devices is disposed fixed around the periphery of the photosensitive drum. Also, in the embodiment as described above, a one drum format was used in which a plurality of developers is selectively brought into opposition with a single photosensitive drum to carry out developing one by one. However, the present invention may also be applied in the same way to a so-called tandem type image forming device in which a plurality of image forming units having a plurality of photosensitive drums and at least one developer for each photosensitive drum is disposed in a straight line, and image forming is carried out simultaneously with a time difference.

INDUSTRIAL APPLICABILITY

The present invention relates to color image forming devices such as photocopiers and printers that use xerography. In particular the present invention may be used in color image forming devices that use xerography that transfer toner images formed on an image carrier onto a recording medium via an intermediate transfer member.

The term "configured" as used herein to describe a component, section or part of a device includes hardware and/or software that is constructed and/or programmed to carry out the desired function.

Moreover, terms that are expressed as "means-plus function" in the claims should include any structure that can be utilized to carry out the function of that part of the present invention.

GENERAL INTERPRETATION OF TERMS

In understanding the scope of the present invention, the term "configured" as used herein to describe a component, section or part of a device includes hardware and/or software that is constructed and/or programmed to carry out the desired function. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including," "having," and their derivatives. Also, the terms "part," "section,"

"portion," "member," or "element" when used in the singular can have the dual meaning of a single part or a plurality of parts. As used herein to describe the present invention, the following directional terms "forward, rearward, above, downward, vertical, horizontal, below, and transverse" as well as any other similar directional terms refer to those directions of an image forming device equipped with the present invention. Accordingly, these terms, as utilized to describe the present invention should be interpreted relative to an image forming device equipped with the present invention as normally used. Finally, terms of degree such as "substantially," "about," and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. An image forming device, comprising:

an image carrier being configured to carry electrostatic latent images;

a developer being configured to provide toner to electrostatic latent images formed on the image carrier;

an intermediate transfer belt, toner images formed on the image carrier being configured to be transferred to the intermediate transfer belt;

a primary transfer member being configured to transfer toner images formed on the image carrier to the intermediate transfer belt;

a secondary transfer member being configured to transfer toner images on the intermediate transfer belt to sheets;

a belt cleaning unit having a fur brush being configured to recover electrically toner, the belt cleaning unit being configured to recover transfer toner remaining on the intermediate transfer belt after a secondary transfer by the secondary transfer member; and an opposing electrode being disposed in a position in opposition to both the fur brush and the secondary transfer member to sandwich the intermediate transfer belt.

2. The image forming device according to claim 1, wherein the belt cleaning unit is configured to be separable from the intermediate transfer belt.

3. The image forming device according to claim 2, wherein the fur brush has brush fibers formed from an electrically conducting material, the intermediate transfer belt is formed from an electrically conducting material whose surface resistivity is within the range $5.1\times10^{8}$ through $1.0\times10^{10}$ Ω/□, and the volume resistance of the brush fibers is within the range $3.2\times10^{5}$ through $2.1\times10^{7}$Ω.

4. The image forming device according to claim 3, wherein the opposing electrode is a grounded roller member whose surface is formed from an electrically conducting elastic member disposed in opposition to the fur brush.

5. The image forming device according to claim 4, wherein the cleaning unit further comprises a housing, at least a portion of the housing being formed from an electrically conducting material to which a bias is applied, and a recovery roller formed from an electrically conducting material and supported by the housing.

6. The image forming device according to claim 5, wherein the distance from the center of the rotation axis of the fur brush to the intermediate transfer belt is greater than the distance from the center of the rotation axis of the fur brush to the surface of the recovery roller.

7. The image forming device according to claim 3, wherein the cleaning unit further comprises a housing, at a portion of the housing being formed from an electrically conducting material to which a bias is applied, and a recovery roller formed from an electrically conducting material and supported by the housing.

8. The image forming device according to claim 7, wherein the distance from the center of the rotation axis of the fur brush to the intermediate transfer belt is greater than the distance from the center of the rotation axis of the fur brush to the surface of the recovery roller.

9. The image forming device according to claim 2, wherein the opposing electrode is a grounded roller member whose surface is formed from an electrically conducting elastic member disposed in opposition to the fur brush.

10. The image forming device according to claim 2, wherein the cleaning unit further comprises a housing, at least a portion of the housing being formed from an electrically conducting material to which a bias is applied, and a recovery roller formed from an electrically conducting material and supported by the housing.

11. The image forming device according to claim 10, wherein the distance from the center of the rotation axis of the fur brush to the intermediate transfer belt is greater than the distance from the center of the rotation axis of the fur brush to the surface of the recovery roller.

12. The image forming device according to claim 1, wherein the fur brush has brush fibers formed from an electrically conducting material, the intermediate transfer belt is formed from an electrically conducting material whose surface resistivity is within the range $5.1\times10^{8}$ through $1.0\times10^{10}$ Ω/□, and the volume resistance of the brush fibers is within the range $3.2\times10^{5}$ through $2.1\times10^{7}$Ω.

13. The image forming device according to claim 12, wherein the opposing electrode is a grounded roller member whose surface is formed from an electrically conducting elastic member disposed in opposition to the fur brush.

14. The image forming device according to claim 12, wherein the cleaning unit further comprises a housing, at least a portion of the housing being formed from an electrically conducting material to which a bias is applied, and a recovery roller formed from an electrically conducting material and supported by the housing.

15. The image forming device according to claim 14, wherein the distance from the center of the rotation axis of the fur brush to the intermediate transfer belt is greater than the distance from the center of the rotation axis of the fur brush to the surface of the recovery roller.

16. The image forming device according to claim 1, wherein the opposing electrode is a grounded roller member whose surface is formed from an electrically conducting elastic member disposed in opposition to the fur brush.

17. The image forming device according to claim 16, wherein the cleaning unit further comprises a housing, at least a portion of the housing being formed from an electrically conducting material to which a bias is applied, and a recovery roller formed from an electrically conducting material and supported by the housing.

18. The image forming device according to claim 17, wherein the distance from the center of the rotation axis of the fur brush to the intermediate transfer belt is greater than the distance from the center of the rotation axis of the fur brush to the surface of the recovery roller.

19. The image forming device according to claim 1, wherein the cleaning unit further comprises a housing, at least a portion of the housing being formed from an electrically conducting material to which a bias is applied, and a recovery roller formed from an electrically conducting material and supported by the housing.

20. The image forming device according to claim 19, wherein the distance from the center of the rotation axis of the fur brush to the intermediate transfer belt is greater than the distance from the center of the rotation axis of the fur brush to the surface of the recovery roller.

* * * * *